US007113393B2

(12) United States Patent
Kirchhoff

(10) Patent No.: US 7,113,393 B2
(45) **Date of Patent: *Sep. 26, 2006**

(54) ADJUSTABLE KEYBOARD SUPPORT ASSEMBLY

(75) Inventor: Kenneth J. Kirchhoff, Gem Lake, MN (US)

(73) Assignee: 3M Innovative Properties Company, St. Paul, MN (US)

( * ) Notice: Subject to any disclaimer, the term of this patent is extended or adjusted under 35 U.S.C. 154(b) by 184 days.

This patent is subject to a terminal disclaimer.

(21) Appl. No.: 10/715,747

(22) Filed: Nov. 18, 2003

(65) Prior Publication Data

US 2005/0105255 A1 May 19, 2005

(51) Int. Cl.
*G06F 1/16* (2006.01)

(52) U.S. Cl. ..... 361/680

(58) Field of Classification Search ..... 361/680
See application file for complete search history.

(56) References Cited

U.S. PATENT DOCUMENTS

| | | | |
|---|---|---|---|
| 4,350,098 | A | 9/1982 | Shirono et al. |
| 4,635,893 | A | 1/1987 | Nelson |
| 4,693,444 | A | 9/1987 | Williams et al. |
| 4,736,689 | A | 4/1988 | Stanko |
| 4,923,259 | A | 5/1990 | Bartok |
| 4,986,616 | A | 1/1991 | Chang et al. |
| 4,988,066 | A | 1/1991 | Cotterill |
| 5,141,196 | A | 8/1992 | Arnold et al. |
| 5,176,351 | A | 1/1993 | Moore |
| 5,213,401 | A | 5/1993 | Hatcher |
| 5,294,087 | A | 3/1994 | Drabczyk et al. |
| 5,302,015 | A | 4/1994 | Du Vall |
| 5,351,897 | A | 10/1994 | Martin |
| 5,405,204 | A | 4/1995 | Ambrose |
| 5,465,931 | A | 11/1995 | MacDonald |
| 5,487,525 | A | 1/1996 | Drabczyk et al. |
| 5,509,628 | A | 4/1996 | Noble |
| 5,533,820 | A | 7/1996 | Ambrose |
| 5,546,271 | A | 8/1996 | Gut et al. |
| 5,555,819 | A | 9/1996 | Lochridge |
| 5,567,067 | A | 10/1996 | Ambrose |

(Continued)

FOREIGN PATENT DOCUMENTS

| | | |
|---|---|---|
| WO | WO 93/25115 | 12/1993 |

(Continued)

OTHER PUBLICATIONS

U.S. Appl. No. 10/715,637, filed on Nov. 18, 2003, Adjustable Keyboard Support Assembly Method of Use.

(Continued)

*Primary Examiner*—Yean-Hsi Chang

(57) ABSTRACT

The invention is a method for adjusting a keyboard support assembly from a storage position under a support surface to a use position. A keyboard tray is extended in a direction generally parallel to and past the support surface. A first side arm is translated in a direction generally parallel to the support surface. A front portion of the first side arm is attached to the keyboard tray at a front attachment point. A front sliding member portion of the first side arm and a rear sliding member portion of the first side arm is slid along a rail. The rail is fixably mounted to a mounting surface. A positioning surface of the first side arm is engaged with a positioning mechanism fixed to the mounting surface. The front portion of the first side arm is forced to rotate the first side arm about a pivot point in the rear sliding member due to the engagement of the positioning surface with the positioning mechanism. The keyboard tray is translated in an upward direction.

19 Claims, 10 Drawing Sheets

U.S. PATENT DOCUMENTS

| | | | | |
|---|---|---|---|---|
| 5,582,375 | A | 12/1996 | Martin | |
| 5,595,428 | A | 1/1997 | Huang | |
| 5,626,323 | A | 5/1997 | Lechman et al. | |
| 5,895,020 | A | 4/1999 | Danzyger et al. | |
| 6,079,680 | A | 6/2000 | Kochanski et al. | |
| 6,082,692 | A | 7/2000 | Price | |
| 6,116,557 | A | 9/2000 | Choy et al. | |
| 6,176,456 | B1 | 1/2001 | Wisniewski | |
| 6,179,261 | B1 | 1/2001 | Lin | |
| 6,186,460 | B1 | 2/2001 | Lin | |
| 6,467,737 | B1 | 10/2002 | Dorantes | |
| 6,536,728 | B1 * | 3/2003 | Hagglund et al. | 248/286.1 |
| 2003/0042380 | A1 | 3/2003 | Hagglund et al. | |

FOREIGN PATENT DOCUMENTS

| | | |
|---|---|---|
| WO | WO 95/22274 | 8/1995 |
| WO | WO 00/66936 | 11/2000 |

OTHER PUBLICATIONS

Staples Encyclopedia of Supplies 2000—#360546—Keyboard Drawers p. 431.

Eldon Operating Instructions, 1998 Newell Office Products Inc., 7-75-955A.

* cited by examiner 12
10
15
70
84
64
18
90
78
82
62

12
10
15
84
94
18
92
90
70
20A
82
62

12
10
15
84
94
18
90
20A
70
82
62

ADJUSTABLE KEYBOARD SUPPORT ASSEMBLY

TECHNICAL FIELD

The present invention relates to keyboard support assemblies. More particularly, the present invention provides a keyboard support assembly with height and tilt adjustment features.

BACKGROUND OF THE INVENTION

Workstations for computers and computer-related equipment typically include at least a computer monitor, a keyboard, and a mousing device. To conserve space and to provide the user with flexibility in positioning the keyboard and mousing device relative to the computer monitor, it is often desirable for the workstation to include a keyboard drawer or keyboard support assembly. The keyboard support assembly typically includes a tray for supporting the keyboard and a mechanical connection that allows movement of the keyboard tray from its storage position when the keyboard is not in use to its open or extended position when the user wishes to use the keyboard.

Keyboard support assemblies may further include mechanical devices for moving the keyboard from its storage position to a position in front of the user that allows safe and comfortable operation of the keyboard. Because proper positioning of the keyboard can provide ergonomic benefits to the user, various alternatives are available for adjusting both the keyboard height and keyboard angle. However, many of the known devices are awkward to adjust and may not provide the user with an adequate number of keyboard height and angle adjustment options to achieve the desired ergonomic benefits. Thus, it is desirable to provide a keyboard support assembly that is easy to use and that gives the user a wide range of adjustment alternatives.

SUMMARY OF THE INVENTION

The invention is an adjustable keyboard support assembly that is securable to a mounting surface. The keyboard assembly includes at least one arm having a first end and a second end and also includes a top and a bottom surface and front attachment point and rear pivot point. A keyboard tray is attached to the first end of each arm at the front attachment point. At least one rail is engaged with the second end of each arm at the rear pivot point, and the rear pivot point is able to translate in a generally linear direction along the rail. A first arm axis extends between the front attachment point and rear pivot point. A positioning surface is disposed along the bottom surface of the second end of each arm. At least one positioning mechanism is fixed in relation to the mounting surface and disposed so as to engage each positioning surface. An arm positioning dimension is defined in a generally vertical direction between the arm axis and the positioning mechanism. The arm positioning dimension increases from the portion of the positioning surface most distal from the rear pivot point to the portion of the positioning surface most proximate to the rear pivot point.

BRIEF DESCRIPTION OF THE DRAWINGS

The present invention will be further explained with reference to the appended Figures, wherein like structure is referred to by like numerals throughout the several views.

DETAILED DESCRIPTION OF THE PREFERRED EMBODIMENTS

Figure 1:
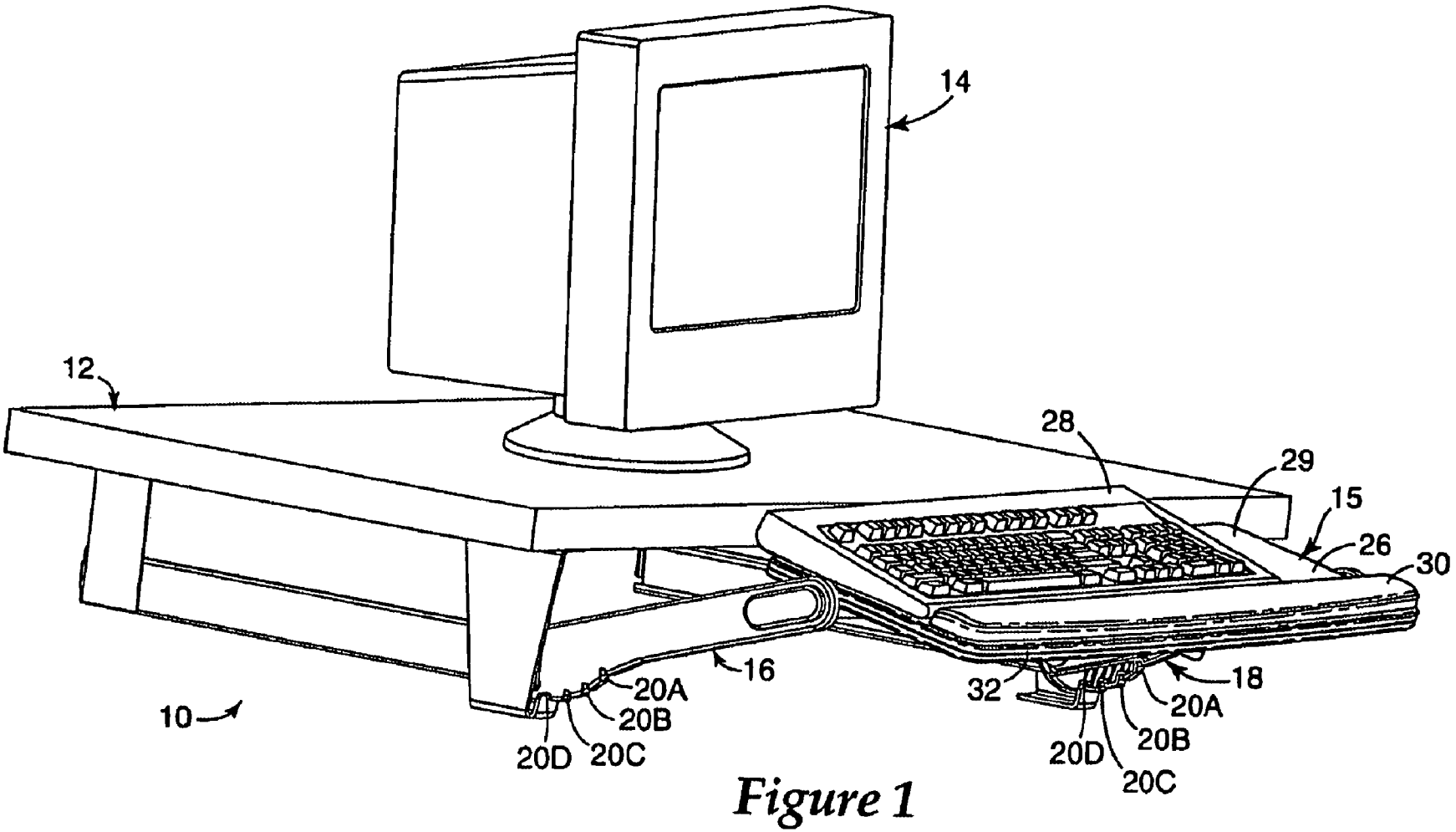
FIG. 1 is an isometric view of an exemplary embodiment of adjustable keyboard support assembly of the present invention with the keyboard tray in an extended position.

One embodiment of the present inventive adjustable keyboard support assembly (or keyboard assembly) is illustrated at 10 in FIG. 1. Keyboard support assembly 10 is mounted to support surface 12 (e.g. a desk). A computer monitor 14 can be positioned on support surface 12, directly above the inventive keyboard assembly 10 for viewing by an operator during keyboarding.

Adjustable keyboard assembly 10 is illustrated in its extended or open position and includes keyboard tray 15, first side arm 16, and second side arm 18. In one embodiment, side arms 16 and 18 are essentially mirror images of each other. In the illustrated embodiment, side arms 16 and 18 include four notches 20A, 20B, 20C and 20D.

Keyboard tray 15 has top surface 26 that is generally flat for receiving a keyboard 28. Keyboard tray 15 is preferably large enough to accommodate any conventional keyboard, and is more preferably large enough to also provide flat area 29 beyond one of the sides of a keyboard for manipulating a computer mouse (not shown). Keyboard tray 15 is also preferably large enough to accommodate wrist rest 30 along front edge 32 of keyboard tray 15 for cushioning the wrists of a person using the keyboard. Wrist rest 30 may extend across entire front edge 32, or may extend only across a portion of front edge 32. Many types of wrist rests would be appropriate, such as gel-filled wrist rests, foam wrist rests, and the like.

Figure 2:
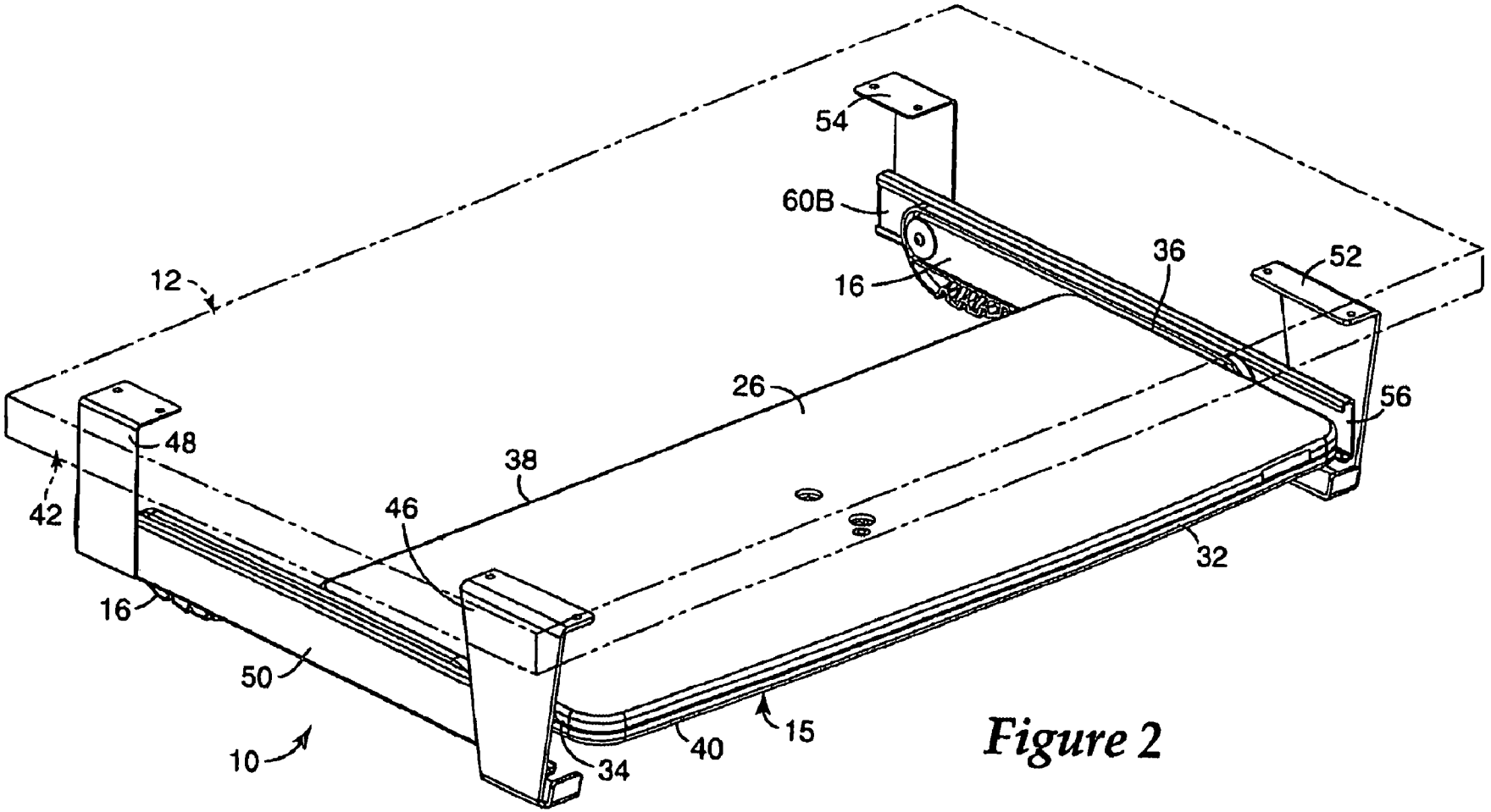
FIG. 2 is an isometric view of an exemplary embodiment of the adjustable keyboard support assembly of FIG. 1 with the keyboard tray in a retracted or storage position.

FIG. 2 illustrates the keyboard support assembly 10 in a retracted (or storage position), where keyboard tray 15 is stored under support surface 12 (indicated by phantom lines) when not in use and from which keyboard tray 15 can be extended and raised when desired for use of keyboard by an operator. For purposes of clarity, the keyboard illustrated in FIG. 1 has been omitted from this view.

Top surface 26 of keyboard tray 15 may be smooth across its width, however, a portion or the entire top surface 26 may be textured with one or more texturing methods. For example, the area of top surface 26 on which a keyboard will be placed may have a grooved or textured surface to minimize or prevent slippage of the keyboard, while the area of top surface 26 on which a mouse will likely be used can be provided with a microstructured surface such as that material commercially available from 3M Company of St. Paul, Minn., under the trade designation "PRECISE MOUS- ING SURFACE". Any textured or smooth surfaces that are provided may be permanently affixed to or imbedded in top surface 26, or may be removable from top surface 26.

Keyboard tray 15 also includes first and second side edges 34 and 36 on opposite ends of front edge 32, and back edge 38 generally opposite front edge 32. Keyboard tray 15 is preferably generally rectangular in shape, with each set of opposite edges parallel to each other, however, keyboard tray 15 may include at least one set of edges that are not parallel to each other, such as curvilinear edges or angled edges that may or may not be identical on opposite sides of the tray. Keyboard tray 15 may also include more or less than four edges, or may comprise a more irregular or curved shape that does not have distinct edges. Bottom surface 40 of keyboard tray 15 is the surface that is generally opposite top surface 26, where bottom surface 40 may be parallel to top surface 26, but may instead be at some other orientation relative to top surface 26. Further, keyboard tray 15 is a multiple piece assembly in this embodiment, where one piece includes top surface 26 and a separate piece comprises bottom surface 40, where these pieces are attached to each other during the assembly of keyboard tray 15. Keyboard tray 15 may instead comprise only a single piece construction, or may comprise more than two pieces.

Keyboard support assembly 10 is secured to mounting surface 42, which in the illustrated embodiment is the underside of support surface 12. It should be understood, however, that mounting surface 42 may be any structure which can adequately support the weight of the inventive keyboard support assembly 10. First front bracket 46 and first rear bracket 48 secure first rail 50 to support surface 12 and second front bracket 52 and second rear bracket 54 secure second rail 56 to support surface 12. Brackets may be secured to rails by any number of methods known in the art (welding, riveting, screws, etc.). Brackets 46, 48, 52, and 54 may be secured to mounting surface in any number of ways known to one skilled in the art (e.g., nailing, screwing, gluing, welding, etc.). First and second rails 50 and 56 extend generally parallel to each other and typically extend parallel to support surface 12. Each of the rails 50 and 56 may be continuous, however, the rails may instead comprise more than one rail section secured individually to front and rear brackets, respectively. Additionally, in an alternate embodiment, a single side arm and rail may be used to secure the keyboard support assembly to support the surface instead of having two or more side arms and two or more rails.

Figure 2A:
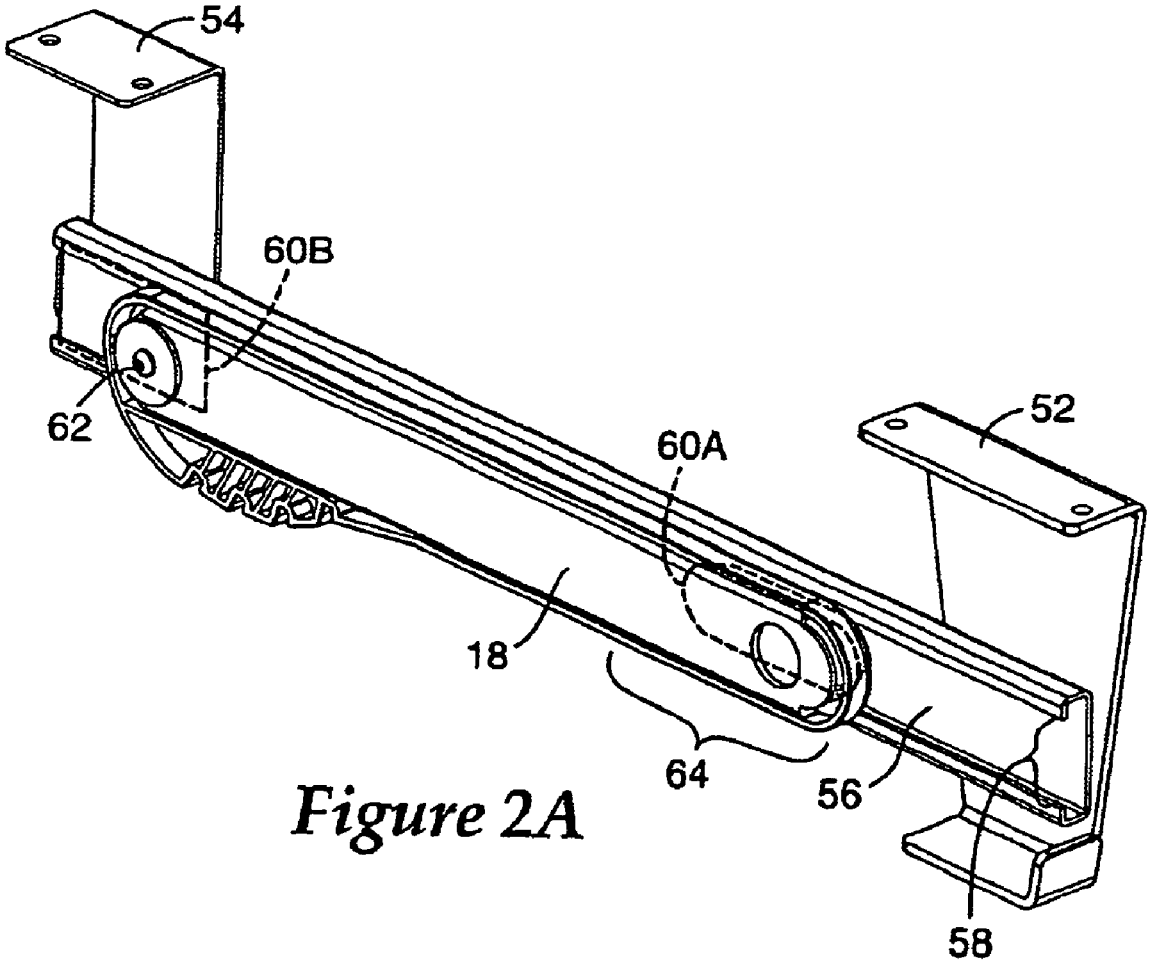
FIG. 2A is an isometric view of one arm and one of the current invention.

FIG. 2A is an isometric view of second rail 56, second front and rear brackets 52 and 54, and second side arm 18. Rail 56 is shown as a single C-shaped piece of material, but may have an alternate configuration as long as the mating side arm 18 is configured to allow it to translate along rail 56. In the disclosed configuration, the C-shape material defines channel 58 for receiving and retaining front sliding member 60A and rear sliding member 60B. In the illustrated embodiment, sliding members 60A and 60B are generally rectangular plates that have a shape and size that allows them to be captured within channel 58, yet allows them to slide relatively easily along the length of the rails in a linear motion. Alternatively, sliding member 60A and 60B could have another shape, such as circular, oval, or any other shape that could be received by a corresponding rail system. Rear sliding member 60B includes rear pivot point 62, which allows side arm 18 to pivot with respect to rail 56 (thereby changing the height of attached keyboard tray 15, previously illustrated). Front sliding member 60A prevents side arm 18 from pivoting downward (due to gravity) when the keyboard support assembly 10 is in the "stored" position, by securing front portion 64 of side arm 18 in rail 56.

Figure 3:
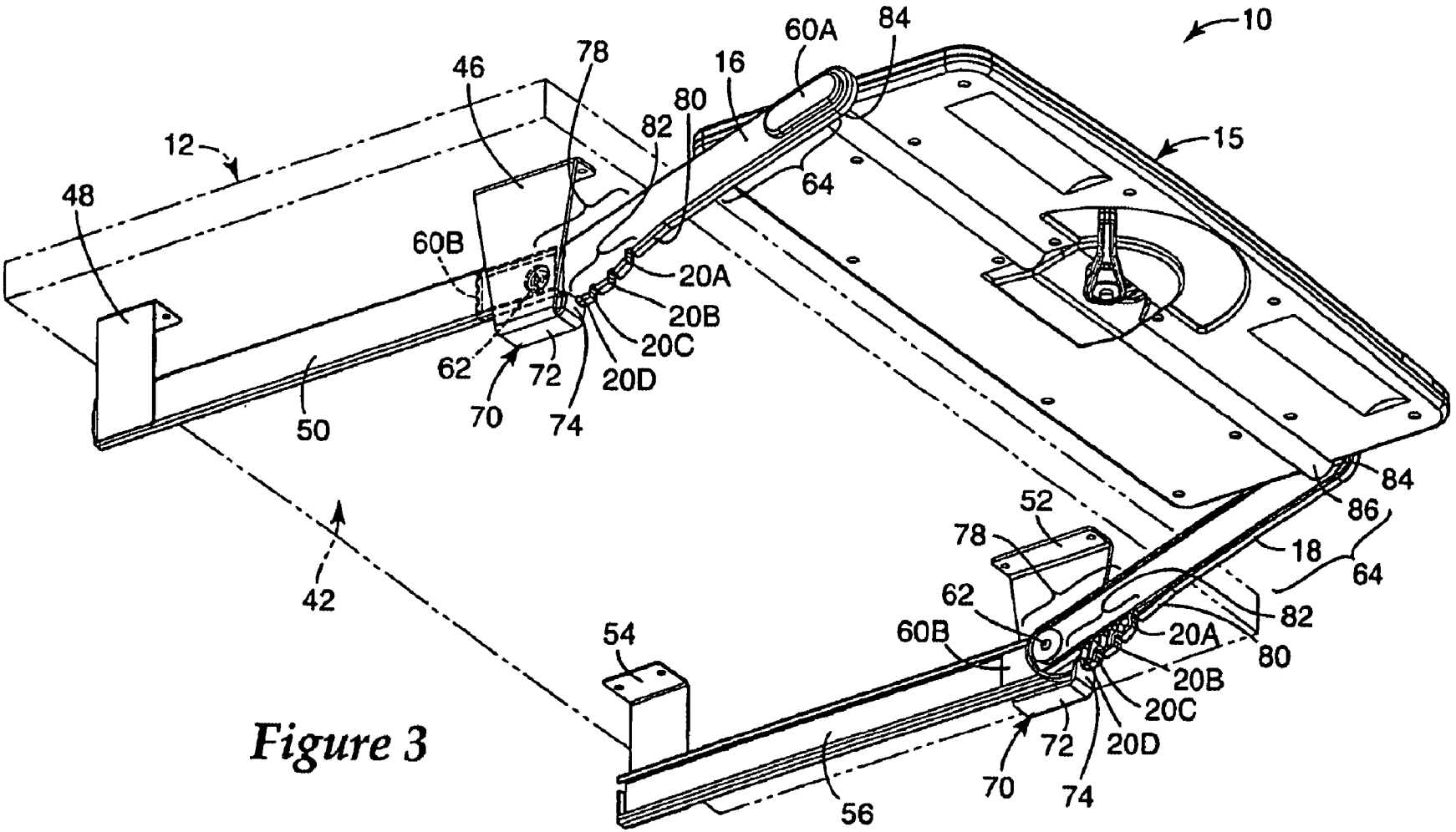
FIG. 3 is an isometric view of an exemplary embodiment of the inventive adjustable keyboard support assembly of the present invention shown in an extended position.

FIG. 3 illustrates the keyboard support assembly 10 in an extended or "use" position. As side arms 16 and 18 are translated out from under support surface 12, positioning mechanisms 70 engage each side arm 16 and 18, and act to prevent side arms 16 and 18 from pivoting downward, as well as acting to adjust the upwards angle of side arms 16 and 18, as discussed further below with respect to FIGS. 5A–5D. Positioning mechanisms 70 are illustrated as a generally L-shaped member having straight portion 72 and hook portion 74. As shown, straight portion 72 is generally parallel to support surface 12, and both portions 72 and 74 extend in a generally perpendicular direction to the plane defining rail 56. It should be noted that while positioning mechanisms 70 are illustrated as being integral to brackets 46 and 52, they may be mounted separately to mounting surface 42 (or other acceptable surfaces) without departing from the inventive concept.

It is contemplated that rails 50 and 56 could be different in shape from each other, as long as the differences in the rails allow consistent motion of both sides of the keyboard tray relative to the housing 12. Additionally, although the illustrated embodiment of the current invention shows a single rail disposed generally on opposite sides of the keyboard assembly 10, it is also contemplated that a rail system of the present invention could comprise only one rail (for example, disposed in the center of the keyboard assembly) or alternatively, more than a single rail on each side of the keyboard assembly (for example, two rails on opposite sides of the keyboard support assembly, for a total of four rails). If a rail system having more than one rail on each side is used, the sliding members used on each arm would need to be adapted for sliding on such a rail system.

In order to support the weight of the keyboard and provide stability during use, keyboard assembly 10 must be made of a material that is sufficiently strong enough that it resists bending and breaking. However, it is also desirable that the material chosen for keyboard assembly 10 is relatively lightweight to allow the keyboard assembly 10 to be mounted in place below support surface 12 without requiring undue securing force (for example requiring bolts or screws that extend from mounting surface 12 through support surface 12). Additionally, it is desirable to keep the keyboard assembly 10 as light as possible so that the keyboard assembly 10 is not too heavy and awkward for the average user to move and position as desired. Examples of materials that may be used for keyboard assembly 10 include steel, wood, or plastics (e.g., high-impact polystyrene or polycarbonate), however, other materials or combinations of materials are also possible, depending on the desired strength and weight of the keyboard assembly 10.

As illustrated, side arms 16 and 18 are connected to rear sliding members 60B at rear pivot point 62. The pivotal connection could be accomplished, for example, with a screw and washer arrangement. As keyboard tray is extended into its "use" position, positioning mechanisms 70 engage side arms 16 and 18, at rear portion 78 of side arms 16 and 18. Specifically, positioning mechanisms engage arm 16 and 18 on bottom surface of arms 16 and 18 along a discrete area. This positioning surface is indicated by reference numeral 82. In the embodiment illustrated, notches 20A through 20D extend into positioning surface 82. Hook portion 74 of positioning mechanism 70 slides into notch 20A as keyboard tray 15 is extended, preventing keyboard tray 15 from pivoting downward. To further extend keyboard tray 15, the operator lifts keyboard tray 15 sliding hook portion 74 out of notch 20A and then pulls it generally horizontally further away from mounting surface 42 until hook portion 74 engages notch 20B. Positioning surface 82 of each side arm 16 and 18 is disposed at a "downward" angle (e.g. the side arm increases in thickness) such that notch 20B is "lower" than notch 20A relative to positioning surface 82. Since notch 20B is lower (i.e., located further from support surface 12) than notch 20A, the front portion 64 of each side arm 16 and 18 is forced upwardly (i.e., towards support surface 12), thereby acting to adjust keyboard tray 15 upwards. Keyboard tray 15 is maintained in a generally horizontal position by allowing tray to pivot at front pivot 84. Front pivot point is disposed where keyboard tray engages each side arm 16 and 18 and can be any number of connection mechanisms, such as the screw and washer arrangement discussed with respect to rear pivot point 62. In the embodiment illustrated, support bar 86 extends under keyboard tray 15 and front pivot point (or "front attachment point") 84 is disposed at the point where support bar 86 connects to each side arm 16 and 18.

In order to move keyboard tray 15 to its extended or "working" position, keyboard tray 15 can be grasped and pulled in a generally parallel direction to support surface 12 and toward the user, where front sliding members 60A and rear sliding members 60B (and rear pivot points 62) would slide along each rail 50 and 56 until keyboard tray 15 is sufficiently extended forward past support surface 12 to allow its movement upward in a vertical direction without causing side arms 16 and 18 to be obstructed by support surface 12. Keyboard tray 15 can then be supported by a user's hand to control vertical movement, while allowing side arms 16 and 18 to rotate about each arms rear pivot point 62 as keyboard tray 15 is raised to its desired height relative to support surface 12. At this point, hook portion 74 of each position mechanism 70 can be engaged with one of the notches 20A–20D in side arms 16 and 18 to maintain keyboard tray 15 at this desired height. Keyboard tray 15 may then be rotated at front pivot point 84 to achieve the desired tilt of keyboard tray 15 relative to support surface 12.

The steps described above would basically be reversed to store keyboard tray 15, where keyboard tray 15 can be lifted or pushed upward to disengage each positioning mechanism 70 from one of the notches 20A–20D in side arms 16 and 18. Side arms 16 and 18 can rotate about each of their rear pivot points 62 as tray 15 is allowed to simultaneously drop and be pushed in a generally horizontal direction under support surface 12, until tray 15 is generally under the support surface 12. Keyboard tray 15 can then be pushed forward so that both front and rear sliding members 60A and 60B slide along each rail 50 and 56 until keyboard tray 15 is stored completely under support surface 12.

It should be noted that while keyboard tray 15 preferably can be pivoted at front pivot point (or "front attachment point") 84, allowing keyboard tray 15 to be pivoted, keyboard tray 15 may be non-rotatably attached to one or both of side arms 16 and 18 without departing from the spirit and scope of the invention.

Figures 4A, 4B, 4C:
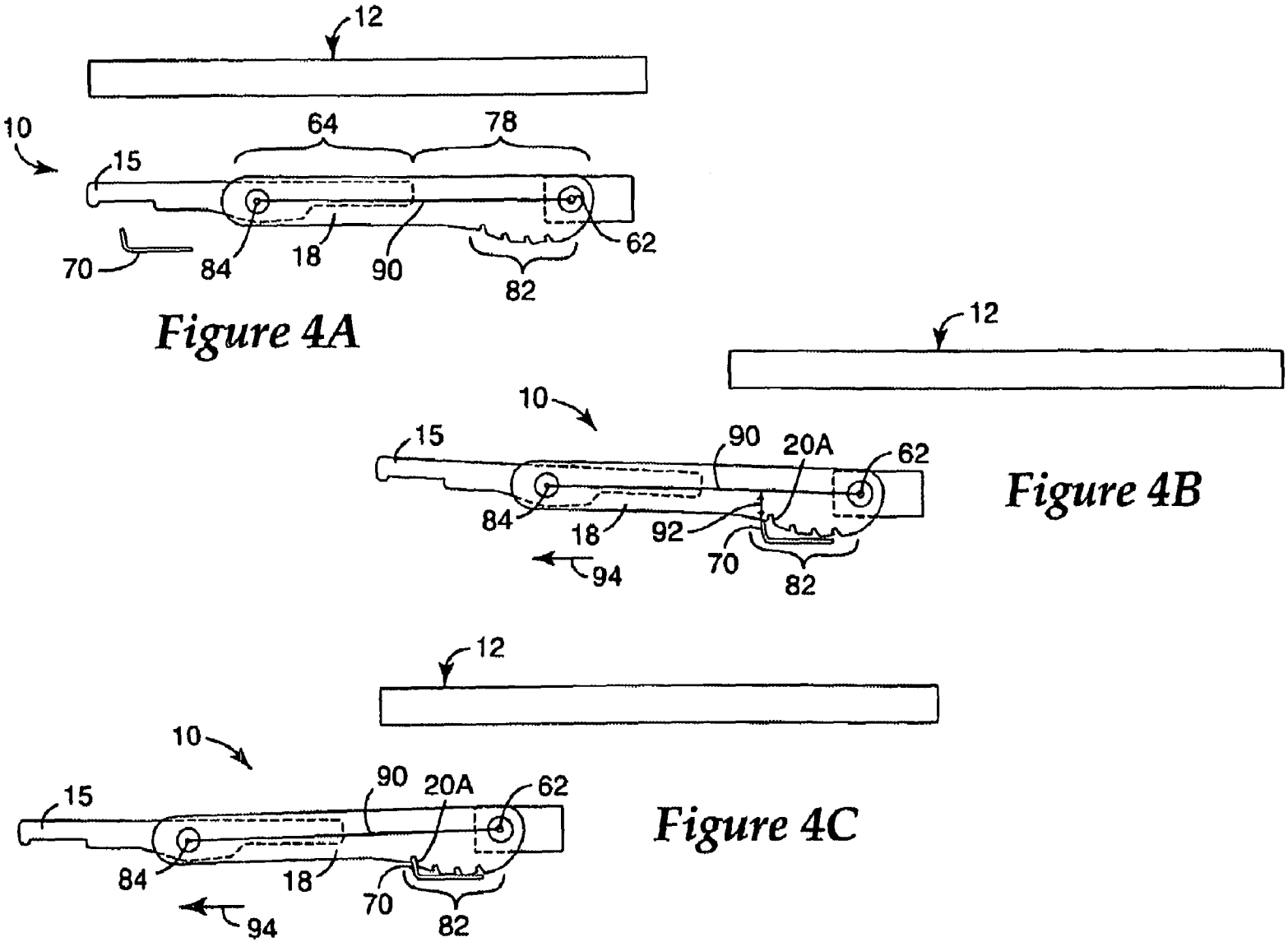
FIGS. 4A through 4I are schematic views of nine positions of one embodiment of one side arm and keyboard tray.

FIGS. 4A through 4E, illustrate the positioning of keyboard tray 15 in more detail. In particular, various positions of one embodiment of keyboard assembly 10 is illustrated as keyboard tray 15 is extended away from and upward toward support surface 12. For the sake of clarity, no rails or brackets are shown, and only one arm is shown. Positioning surface 82 interacts with positioning mechanism 70 to adjust the angle of side arm 18. Notches 20A through 20D are used to lock the position of each side arm (and therefore keyboard tray 15) in place. The shape, size, and position of notches 20A through 20D are designed to engage with hook portion 74 (see FIG. 3) of positioning mechanism 70. FIG. 4A illustrates keyboard tray 15 in its retracted or "stored" position under support surface 12. Arm axis 90 extends between front pivot point (or front attachment point) 84 and rear pivot point 62. It should be noted that side arm 18 can vary beyond the shape illustrated without departing from the scope of the invention, however, in the illustrated embodiment, as the thickness of the arm varies between the arm axis 90 and the positioning surface 82, the height of the keyboard tray 15 is adjusted as positioning mechanism 70 engages positioning surface 82. While positioning surface 82 is indicated as extending only partially along side are 18, positioning surface may extend at any length along the side arms without departing from the scope of the invention. Positioning surface 82, begins at the point where the positioning mechanism begins adjusting the keyboard tray upwardly for use by the operator, even if the positioning member engages the arm of a point prior to where the upward adjustment begins.

Figures 4D, 4E, 4F:
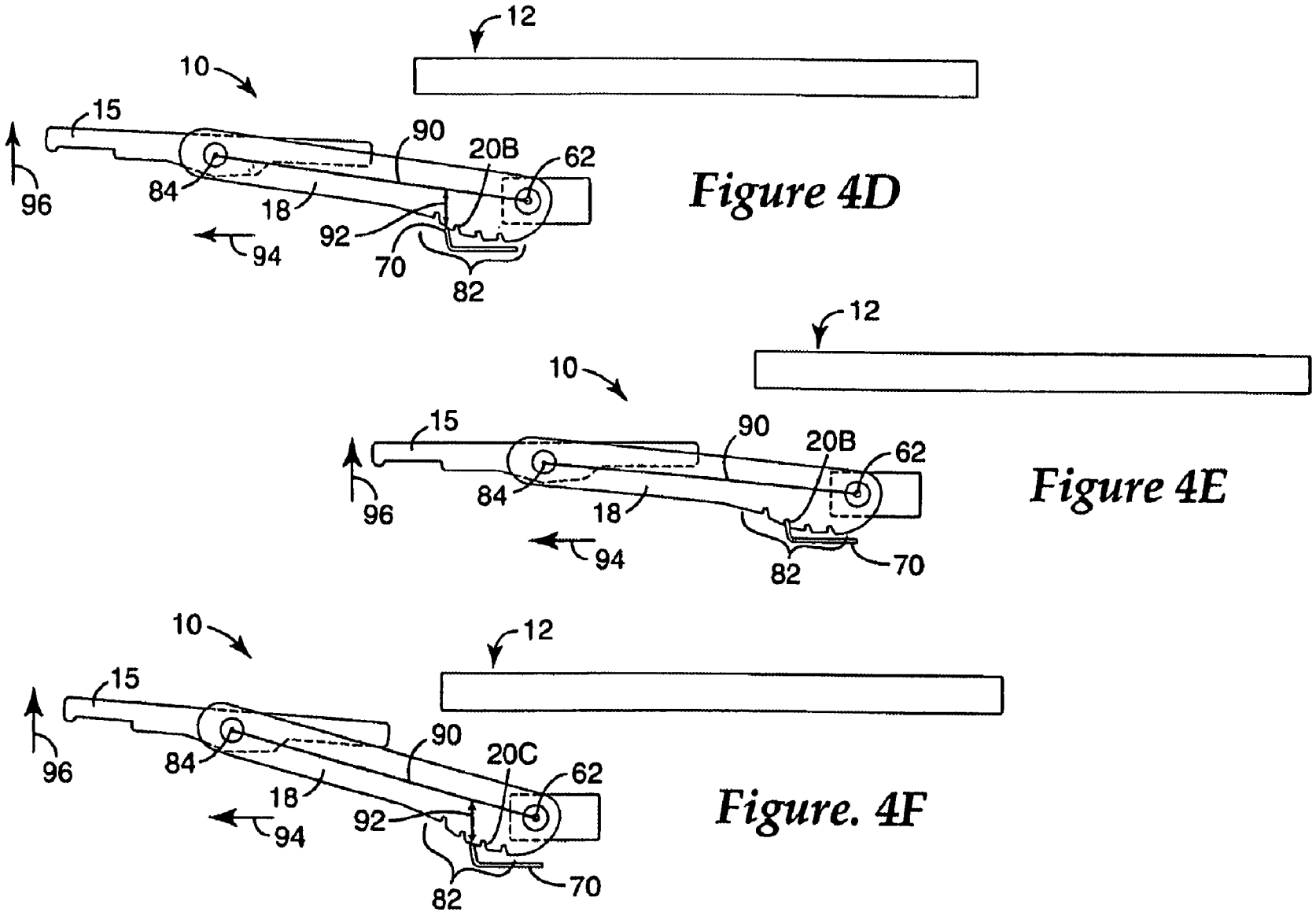
Figure 4G:
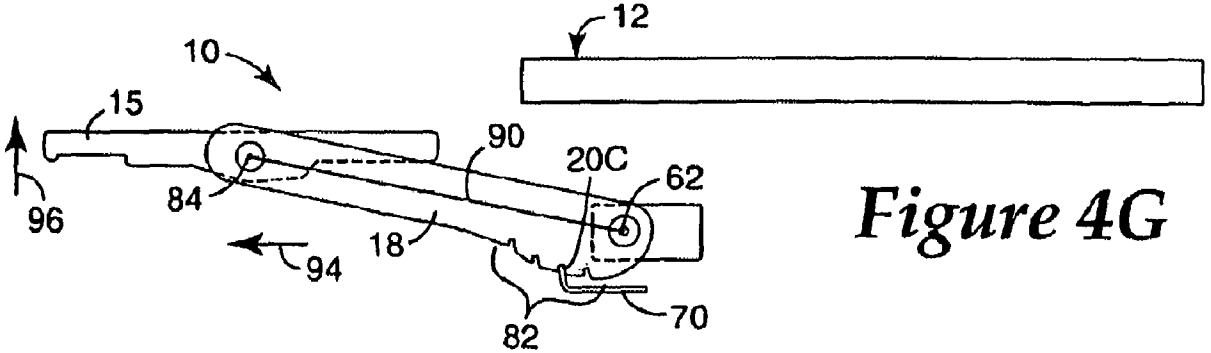
Figure 4H:
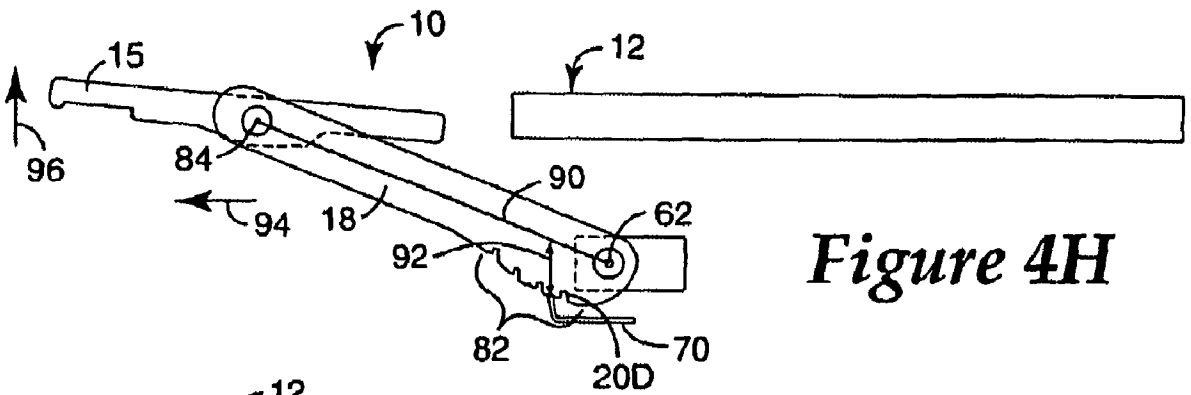
Figure 4I:
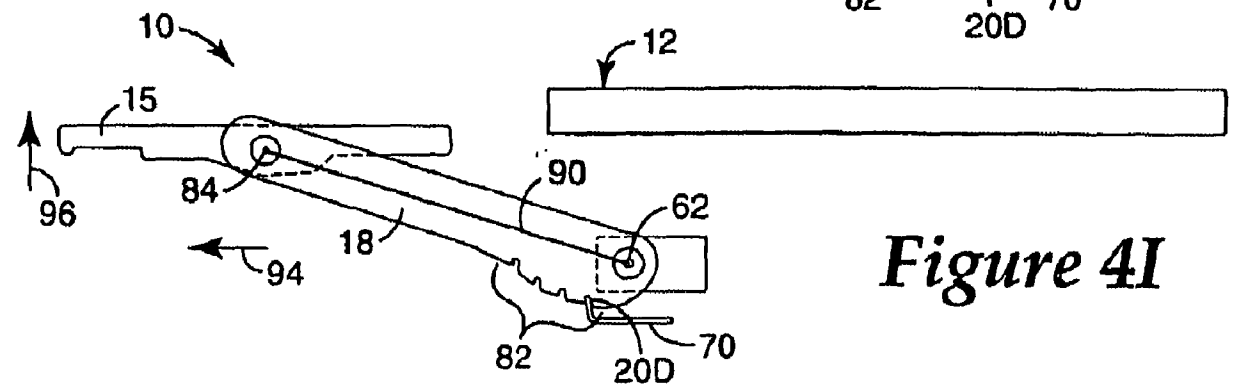
Figures 5A, 5B, 5C:
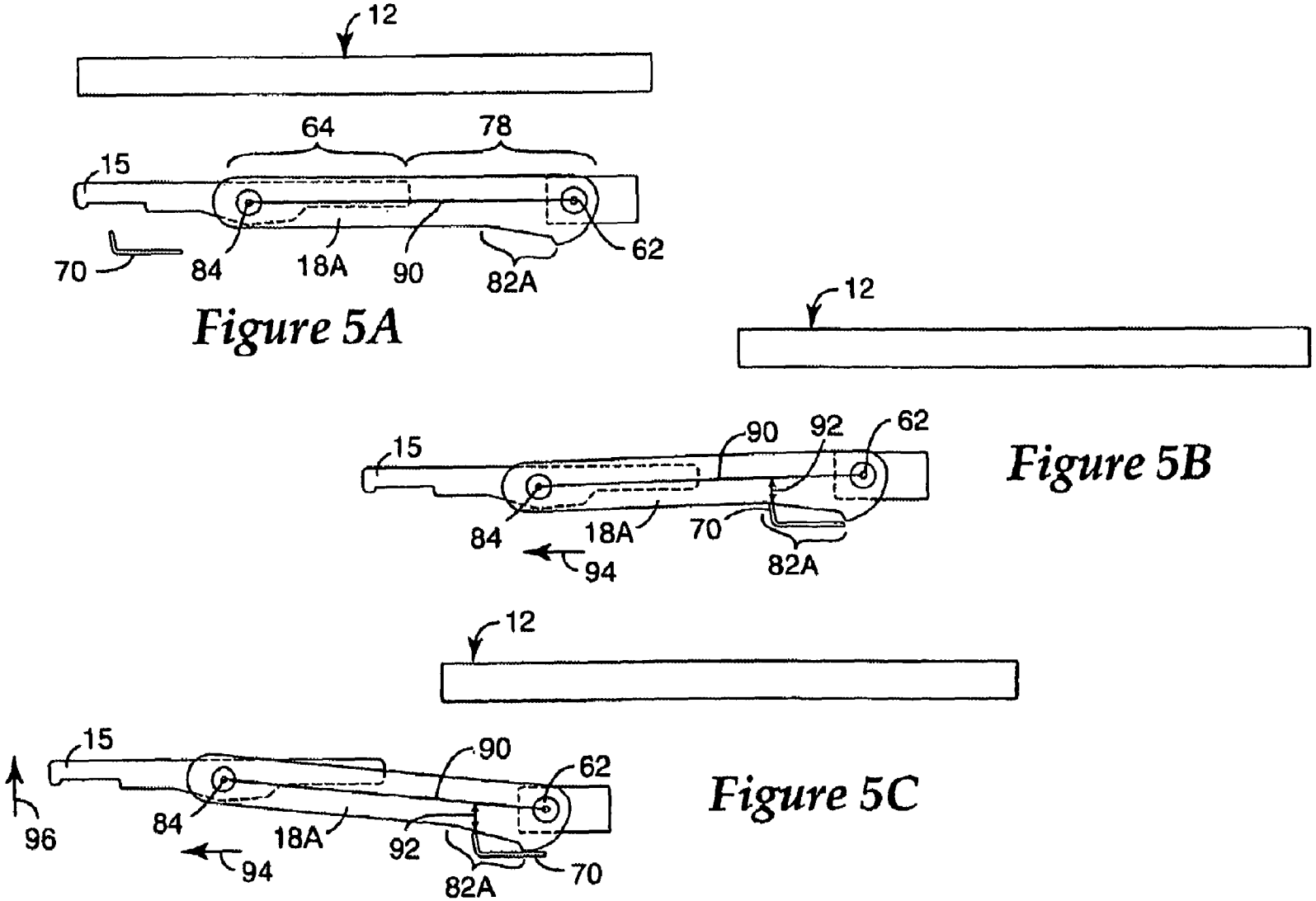
FIGS. 5A through 5E are schematic views of four views of four positions of a second embodiment of one side arm and keyboard tray.
Figure 5D:
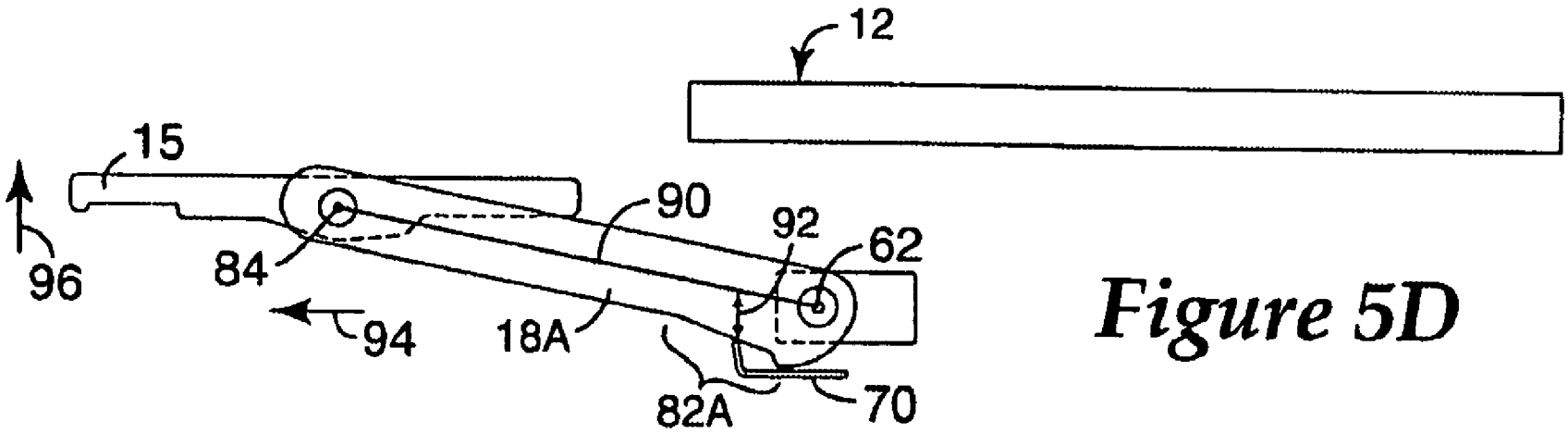
Figure 5E:
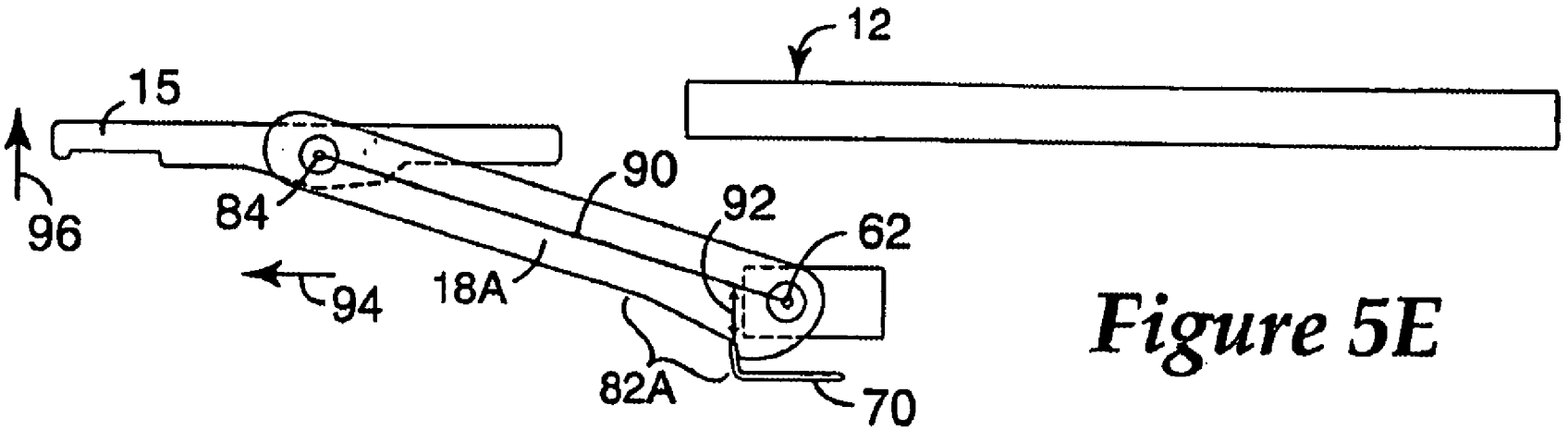

FIG. 4B illustrates the positioning member at a point just prior to engaging notch 20A. The vertical distance between the positioning mechanism 20 and the arm axis 90 is arm positioning dimension (indicated by reference number 92). Again, the arm configuration may be such that the arm is not a solid piece throughout positioning dimension without departing from the scope of the invention. FIG. 4C illustrates positioning mechanism to engaged in notch 20A, providing a first keyboard tray 15 height setting. As keyboard tray 15 is translated in an outward horizontal direction, (as indicated by arrow 94) engaging surface 82 is configured such that the positioning dimension 92 is increased, as shown in FIG. 4D. Increasing arm positioning dimension 92 acts to translate keyboard tray 15 in an upward direction (indicated by arrow 96). FIG. 4E illustrates positioning mechanism 70 engaged in notch 20B, providing a second keyboard tray 15 height setting. FIGS. 4F and 4H illustrate the continued increasing of arm positioning dimension 92 as keyboard tray 15 is translated in a horizontal direction 94, resulting in a vertical (or upwards) movement 96 by the keyboard tray 15. FIGS. 4G and 41 illustrate the positioning mechanism 70 engaged in notch 20C and 20D, respectively, providing a third and fourth keyboard tray 15 height setting. Thus, by configuring the positioning surface to continually increase the arm positioning dimension 92 from the portion of the positioning surface farthest from the rear pivot point 62 to the portion of the positioning surface nearest the rear pivot point 62, the keyboard tray 15 is continually elevated (arrow 96) as it is extended (arrow 94). Stowing the keyboard tray 15 simply reverses the process and as the tray 15 is moved horizontally under the support surface 12, the engagement between the positioning surface 82 and the positioning mechanism 70 (in combination with gravity) allows the tray 15 to be lowered.

It should be noted that in one embodiment, positioning surface 82 can be configured such that the ratio of horizontal movement is linear in relation to the amount of vertical movement by the tray. The embodiment illustrated in FIGS. 4A–4I utilizes an arcuate surface as the positioning surface to accomplish this linear relationship. The curvature of positioning surface 82 in the illustrated embodiment is that of a radius of about 3 inch (2.54 cm). This results in translating the keyboard tray a distance of about 1.7 cm vertically for every about 1 cm the tray is translated horizontally. Other surface configurations (i.e., rate of increasing arm positioning dimension) can be utilized to vary the ratio of vertical to horizontal movement. Additionally, while four notches 20A–20D are illustrated, it would be understood that more or less notches (including no notches) could be provided without departing from the spirit and scope of the invention. Since the configuration of positioning surface 82 provides a linearly increasing height of the keyboard tray in relation to the horizontal distance traveled, equally spacing the notches 20A–20D in the positioning surface results in equally spaced vertical pre-set keyboard tray height positions.

FIGS. 5A–5E illustrate an alternate embodiment of the invention using positioning surface 82A in side arm 18A. In this embodiment, no notches are used to provide pre-determined keyboard height settings. Instead, the user may set the height along any point of positioning surface 82A. Preferably, a positioning surface 82A is provided with some mechanism for preventing slippage between positioning mechanism 70 and positioning surface 82A (such as hook and loop fasteners or a highly roughened surface). Additionally, in the illustrated embodiment, positioning surface 82A (and arm positioning 92) increase linearly from the portion of positioning surface 82 disposed farthest from rear pivot point 62 to the portion of positioning surface 82 disposed closest to rear pivot point 82. (i.e., is not curved as in FIGS. 4A–4I). This results in the keyboard tray 15 increasing in height at an exponential rate with respect to the horizontal movement. In other words, as keyboard tray is moved horizontally (as indicated by arrow 94), the vertical distance the keyboard tray moves (as indicated by arrow 96) increases at an exponential rate as the positioning mechanism travels along the positioning surface 82. This occurs due to the ever decreasing distance between the pivot point 62 and the arm positioning dimension 92 as well as the increasing arm positioning dimension 92 as the tray is extended.

It may be desirable to include notches in the embodiment illustrated in FIGS. 5A–5E (similar to those illustrated in FIGS. 4A–4I) to create pre-determined equally spaced height settings. By varying the distance the notches are spaced on the positioning surface (i.e., spacing them closer together the closer they get to the rear pivot point) equally spaced pre-set height positions of the keyboard tray 15 can be established. In other words, since the height increases exponentially for the horizontal distance moved, by decreasing the distance of horizontal placement of the notches into the positioning surface 82A, the vertical spacing of the pre-set positions can be made constant.

It should be noted that other positioning surface configurations and/or notch spacing can be utilized to create varying vertical translation to horizontal translation of the keyboard tray without departing from the spirit and scope of the invention.

The positioning mechanism used in accordance with the present invention may take any number of configurations, however, the positioning mechanism used is preferably designed to provide positive engagement with a corresponding engaging surface to prevent downward movement of the keyboard tray relative to the work surface when pressure is applied to the surface of the keyboard tray. The positioning mechanism in the illustrated embodiments is preferably selected to provide relatively easy disengagement with notches of the corresponding side arm to allow upward movement of the keyboard tray relative to the work surface by simply lifting or pushing the keyboard tray in an upward direction. While the above description includes a side arm having four notches, more or less notches can be provided in a particular side arm, where a greater number of notches provide the user with more options for pre-determined height settings of the keyboard tray relative to a support surface (e.g., work surface). As mentioned previously, positioning surface may not include notches, but instead may be covered by a non-slip surface with a corresponding non-slip positioning mechanism. As the non-slip positioning mechanism is engaged with the non-slip positioning surface, the coefficient of friction between the mechanism and the positioning surface prevent slippage between the surface and the mechanism, "locking" the angle of the side arm in place and thereby locking the position of the keyboard tray in place. Another possible variation is that one or both of the side arms (which may or may not include notches) are provided with one side of a hook and loop fastener, such as that commercially available from the 3M Company of St. Paul, Minn., under the trade designation "DUAL LOCK", while the positioning mechanism with which the arm will come in contact (e.g., L-shaped member) is provided with the mating side of the hook and loop fastener. More specifically, the positioning surface could be provided with the loop fabric of a hook and loop fastener while the positioning mechanism with which the positioning surface will come in contact could comprise hooks, or vice versa. When these contact each other, positive engagement between the positioning surface and the positioning mechanism will be achieved. To separate these surfaces, the arm would simply need to be pulled away from the positioning mechanism. Alternatively, the positioning surface and positioning mechanism could be provided with intermeshing structured surfaces, magnetically attracted surfaces, textured surfaces, or other removable attachment means.

Figure 6:
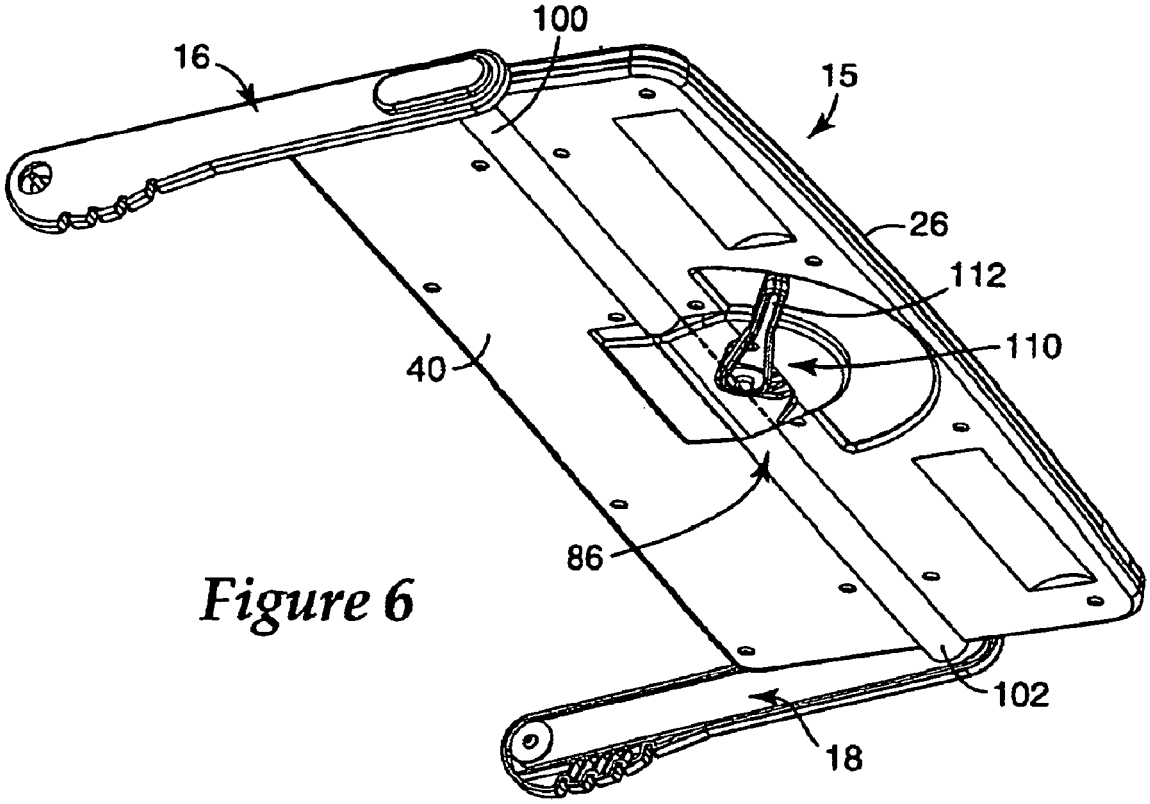
FIG. 6 is an isometric view of one embodiment of the keyboard tray and side arms of FIG. 1.

FIG. 6 illustrates bottom surface 40 of keyboard tray 15 including support bar 86 having first end 100 rigidly attached to first side arm 16 and second end 102 rigidly attached to second side arm 18. In this illustration, support bar 86 is not entirely visible because it is enclosed between portions of keyboard tray 15. The completely enclosed portion of support bar 86 is indicated (for the sake of clarity) in dotted lines.

Keyboard tray 15 of the present invention can preferably be rotated about the longitudinal axis of support bar 86, where the range of rotation may be 360 degrees about support bar 86, or may be limited to movement of less than 360 degrees by stops or other limiting methods or apparatuses. This allows the user to make top surface 26 of keyboard tray 15 "flat" or horizontal, as the keyboard assembly is pivoted upward or downward. The range of rotation should be large enough to accommodate the particular application or environment in which keyboard tray 15 is being used. In addition, it is preferable that keyboard tray 15 has locking mechanism 110 to secure keyboard tray 15 to the rotational position desired by the user. Handle 112 is also shown to allow operator to secure keyboard tray 15 in place using, for example, clamp plates, which are shown and described with respect to FIG. 7.

Figure 7:
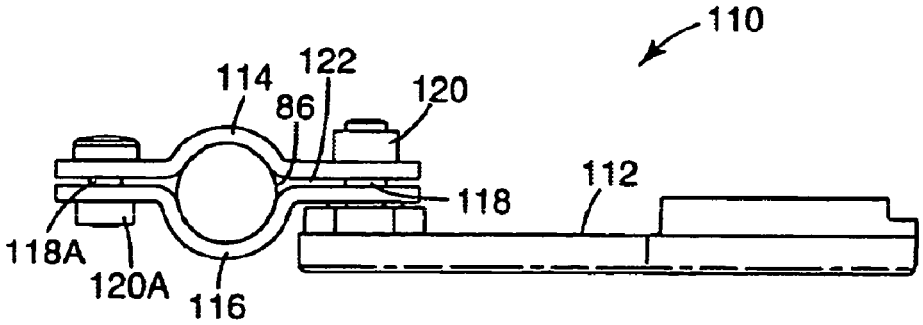
FIG. 7 is a partial side view of an exemplary embodiment of a locking assembly for the keyboard tray of FIG. 6.

FIG. 7 illustrates one example of locking mechanism 110, which basic components comprise handle 112, top clamp plate 114, and bottom clamp plate 116. One end of handle 112 is attached to one side of clamp plates 114 and 116 with screw 118 and self-clinching nut 120, such as the type of nut available from the Penn Engineering and Manufacturing Company of Danboro, Pa. under the trade designation "PEM SELF-CLINCHING NUT". The generally opposite side of top clamp plate 114 is further attached to the generally opposite side of bottom clamp plate 116 with screw 118A and self-clinching nut 120A. A portion of the length of support bar 86 is enclosed between top and bottom clamp plates 114 and 116 with gap 122 provided between the plates on either side of support bar 86. By rotating handle 112, top and bottom clamp plates 114 and 116 are movable relative to each other to vary the size of gap 122 nearest screw 118 and nut 120. Nut 120A is tightened onto screw 118A during assembly of the locking mechanism 110 to provide a specific gap between plates 114 and 116 in the area of screw 118A and nut 120A.

In operation, handle 112 can be rotated in a first direction that tightens nut 120 onto screw 118, which pulls plates 114 and 116 closer to each other, thereby tightening the plates 114 and 116 against support bar 86 along with narrowing the gap 122. Handle 112 can continue to be rotated in the same direction until the gap 122 is sufficiently small and support bar 86 is secured relatively tightly between plates 114 and 116 so that keyboard tray 15 is essentially "locked" into place. To loosen or "unlock" keyboard tray 15 and allow its rotation, handle 112 is rotated in a second direction that is generally opposite to the first direction that locks the keyboard tray rotation. This movement loosens nut 120 so that plates 114 and 116 can move apart from each other and loosen plates 114 and 116 from support bar 86, thereby widening gap 122. Handle 112 can continue to be moved in the second direction until keyboard tray 15 can be rotated relatively freely about support bar 86. Alternatively, plates 114 and 116 may be provided with a threaded hole through which screws 118 and 118A are threaded, so that nuts 120 and 120A are unnecessary.

A wide variety of alternate arrangements are possible for rotation or angular adjustment of a keyboard tray relative to side arms. For one example, the handle of the above-described embodiment may be attached to top and bottom clamp plates with a circular plate or ring arrangement. In this arrangement, a circular plate at one end of the handle has a "stepped" profile and a mating circular plate on the bottom clamp plate has a corresponding "stepped" profile. When the handle is rotated, the circular plates rotate relative to each other, thereby changing the distance between clamp plates to lock or unlock the keyboard tray, as described above. For another example, the support bar does not extend the entire distance between the side arms. Rather, each side arm could comprise a circular shoulder portion extending from one side and toward the other side arm. In this example, the keyboard tray would include a support bar that is attached to the shoulder portions. Rotation or tilting of the keyboard tray in this embodiment could be controlled at one or both side arms, rather than with a locking mechanism under the keyboard tray.

Further variations on the described embodiments are also contemplated by the present invention, including a keyboard support assembly that combines features of the various embodiments. One possible variation is that one side arm is provided with notches for pre-determined height settings of the keyboard tray, or some other device, while the other arm does not have any notches. It should also be understood that use of the keyboard platform to support devices and components other than those described are also contemplated. Thus, the scope of the present invention should not be limited to the structures described herein, but only by the structures described by the language of the claims and the equivalents of those structures.

The present invention has now been described with reference to several embodiments thereof. The entire disclosure of any patent or patent application identified herein is hereby incorporated by reference. The foregoing detailed description and examples have been given for clarity of understanding only. No unnecessary limitations are to be understood therefrom. It will be apparent to those skilled in the art that many changes can be made in the embodiments described without departing from the scope of the invention.

The invention claimed is:

1. An adjustable keyboard support assembly, securable to a mounting surface comprising:

at least one arm having a first end and a second end and opposing top and bottom surfaces;

a keyboard tray attached to the first end of the at least one arm at a front attachment point;

at least one rail engaged with the second end of the at least one arm at a rear pivot point, wherein the rear pivot point is able to be translated in a generally linear direction along the rail;

a first arm axis extending between the front attachment point and rear pivot point;

a positioning surface disposed along the bottom surface of the second end of each arm;

at least one positioning mechanism fixed in relation to the mounting surface and disposed so as to engage the positioning surface;

an arm positioning dimension defined as an orthogonal distance between the first arm axis and the positioning mechanism; and wherein the arm positioning dimension increases from a portion of the positioning surface most distal from the rear pivot point to a portion of the positioning surface most proximate to the rear pivot point.

2. The assembly of claim 1 and further comprising:

a second arm substantially mirrored in construction to the at least one arm and pivotally attached to the keyboard tray at a first end of the second arm at its front attachment point; and two rails substantially mirrored in construction, wherein each rail is slideably engaged with the second end of the arms.

3. The assembly of claim 2 and further comprising:

a support member having opposite first and second ends wherein the first end is attached to the first arm and second end is attached to the second arm;

wherein the front attachment point of the first arm and the front attachment point of the second arm allow pivoting of the keyboard tray with respect to the first arm and the second arm at a point where each arm and the keyboard tray are in supportive engagement.

4. The assembly of claim 3, wherein the keyboard tray further comprises:

a locking device adapted to be engaged to inhibit rotation of the keyboard tray relative to the first arm and second arm and to be disengaged to allow relatively free rotation of the keyboard tray relative to the first arm and second arm.

5. The assembly of claim 4, wherein the locking device comprises:

a handle extending from a bottom side of the keyboard tray, wherein rotation of the keyboard tray relative to the first arm and second arm and rotation of the handle in a second direction loosens the locking device to allow relatively free rotation of the keyboard tray relative to the first arm and the second arm.

6. The adjustable keyboard support assembly of claim 5, wherein the locking device further comprises a top clamp plate on one side of the support member, a bottom clamp plate on the opposite side of the support member, a screw, and a nut, wherein the screw and nut moveably attach the handle to the top and bottom clamp plates.

7. The assembly of claim 1 and further comprising:
at least one notch disposed in the positioning surface.

8. The assembly of claim 7 and further comprising:
four notches disposed in the positioning surface, wherein the notches are substantially equally spaced.

9. The assembly of claim 1 wherein the positioning surface is shaped such that translating the second portion of the side arm a horizontal distance within the rail, results in translation of the keyboard tray a vertical distance, wherein the relationship between the translated horizontal distance and the resulting vertical distance is linear.

10. The assembly of claim 9 and further comprising:
a plurality of notches disposed in the positioning surface at substantially equally spaced distances.

11. The assembly of claim 9 and further comprising:
four notches disposed in the positioning surface, wherein the notches are substantially equally spaced.

12. The assembly of claim 1, wherein the arm positioning dimension of the arm increases in a substantially linear relationship from the portion of the surface, most distal from the rear pivot point to the portion of the positioning surface most proximate to the rear pivot point.

13. The assembly of claim 12 and further comprising:
A plurality of notches disposed in the positioning surface at decreasing intervals.

14. The assembly of claim 13 wherein the notches are spaced from each other such that translating the second portion of the side arm a horizontal distance between each notch results in a translation of the keyboard tray vertical distance, and the relationship between the horizontal distance and the resulting vertical distance is linear.

15. The assembly of claim 1 and further comprising:
at least one mating mechanism for releasably preventing relative movement between the positioning surface and the positioning mechanism.

16. The assembly of claim 13, wherein each notch is shaped for positive engagement with the positioning mechanism.

17. The assembly of claim 16, wherein each positioning mechanism is L-shaped.

18. An adjustable keyboard support assembly, securable to a mounting surface comprising:

two arms, substantially mirrored in construction, each arm having a first end and a second end and opposing top and bottom surfaces;

a keyboard tray attached on opposite sides to the first end of each arm at a front attachment point;

two rails substantially mirrored in construction, each rail engaged with the second end of one arm at a rear pivot point, wherein the rear pivot point is able to be translated in a generally linear direction along the rail;

a first arm axis extending between the front attachment point and rear pivot point;

a positioning surface disposed along the bottom surface of the second end of each arm;

at least one notch disposed in the positioning surface;

at least one L-shaped positioning mechanism fixed in relation to the mounting surface and disposed so as to engage the positioning surface;

an arm positioning dimension defined as an orthogonal distance defined between the first arm axis and the positioning mechanism;

wherein the arm positioning dimension increases from a portion of the positioning surface most distal from the rear pivot point to a portion of the positioning surface most proximate to the rear pivot point;

wherein the positioning surface is shaped such that translating the second portion of each arm a variable horizontal distance within the rail, results in translation of the first portion of the side arm a vertical distance and the relationship between the horizontal distance and the resulting vertical distance is linear.

19. The assembly of claim 18 and further comprising: four notches disposed in the positioning surface, wherein the notches are substantially equally spaced.

* * * * *